US007807059B2

(12) United States Patent
Lundback et al.

(10) Patent No.: US 7,807,059 B2
(45) Date of Patent: Oct. 5, 2010

(54) METHOD AND APPARATUS FOR COLLECTING POLLUTANTS IN A BODY OF WATER

(75) Inventors: Stig Lundback, Vaxholm (SE); Jonas Johnson, Norrtalje (SE)

(73) Assignee: Surfcleaner AB, Vaxholm (SE)

( * ) Notice: Subject to any disclaimer, the term of this patent is extended or adjusted under 35 U.S.C. 154(b) by 0 days.

(21) Appl. No.: 12/245,443

(22) Filed: Oct. 3, 2008

(65) Prior Publication Data

US 2009/0045142 A1 Feb. 19, 2009

Related U.S. Application Data

(62) Division of application No. 10/475,499, filed as application No. PCT/SE02/00865 on May 3, 2002, now Pat. No. 7,445,719.

(30) Foreign Application Priority Data

May 4, 2001 (SE) ..... 0101576

(51) Int. Cl.
*C02F 1/40* (2006.01)

(52) U.S. Cl. ..... 210/741; 210/86; 210/97; 210/115; 210/141; 210/143; 210/242.3; 210/170.11; 210/540; 210/747; 210/776; 210/923

(58) Field of Classification Search ..... 210/85, 210/86, 103, 104, 112–115, 141, 143, 170.11, 210/242.1, 242.3, 538, 540, 739–741, 744, 210/747, 776, 800–803, 923, 122, 123, 138, 210/97; 405/60

See application file for complete search history.

(56) References Cited

U.S. PATENT DOCUMENTS

| | | | | |
|---|---|---|---|---|
| 3,628,660 | A | 12/1971 | In't Veld | 210/104 |
| 3,957,638 | A * | 5/1976 | IN'T Veld | 210/104 |
| 4,032,444 | A * | 6/1977 | Wright et al. | 210/86 |
| 4,341,637 | A * | 7/1982 | Smith | 210/662 |
| 4,404,093 | A * | 9/1983 | Moyer | 210/138 |
| 4,404,903 | A | 9/1983 | Cronin | 101/123 |
| 5,154,835 | A | 10/1992 | DeMichael | 210/744 |
| 5,713,697 | A | 2/1998 | Steiner | 405/60 |
| 5,753,108 | A | 5/1998 | Haynes et al. | 210/122 |
| 5,935,449 | A | 8/1999 | Buehler et al. | 210/742 |
| 6,015,501 | A | 1/2000 | Lundback | 210/776 |

(Continued)

FOREIGN PATENT DOCUMENTS

| | | |
|---|---|---|
| GB | 2229107 | 9/1990 |

(Continued)

*Primary Examiner*—Joseph W Drodge
(74) *Attorney, Agent, or Firm*—Browdy and Neimark, PLLC

(57) ABSTRACT

During collection of pollutants having a density lower than that of water and carried by a surface layer of a body of water, water of the surface layer is caused to flow into and through a collection vessel having a separation compartment with a top wall, pollutants entrained by the inflowing surface layer water are allowed to collect gravimetrically as a supernatant layer carried beneath the top wall of the separation compartment on water in the separation compartment, and changes of the weight of the collection vessel in the body of water are monitored. Intake and discharge phases may be initiated and terminated to in response to the said weight reaching predetermined values.

4 Claims, 6 Drawing Sheets

U.S. PATENT DOCUMENTS

| | | | | |
|---|---|---|---|---|
| 6,375,835 | B1 | 4/2002 | Lee et al. | 210/86 |
| 6,423,213 | B1 | 7/2002 | Mazurek | 210/115 |
| 6,773,611 | B2 * | 8/2004 | Perlich et al. | 210/758 |
| 7,445,719 | B2 * | 11/2008 | Lundback et al. | 210/741 |

FOREIGN PATENT DOCUMENTS

| | | |
|---|---|---|
| WO | WO 97/07292 | 2/1997 |
| WO | WO 99/22078 | 5/1999 |
| WO | WO 01/12905 | 2/2001 |

* cited by examiner

METHOD AND APPARATUS FOR COLLECTING POLLUTANTS IN A BODY OF WATER

BACKGROUND OF THE INVENTION

Prior Art

A known method for collecting pollutants having a density higher than that of water and carried by a surface layer of a body of water uses a skimmer apparatus, that is, an apparatus by which the surface layer of the body of water is skimmed off into a collection vessel. An example is shown in WO01/12905 A1.

The method is cyclical with each cycle of operation comprising an intake phase and a discharge phase. During the intake phase, the surface layer runs into a collection vessel having a separation compartment with a top wall. The inflow into the collection vessel takes place through an inlet that communicated with the separation compartment. During the intake phase the pollutants entrained by the inflowing surface layer are allowed to collect gravimetrically, that is, by virtue of their lower density, as a layer of pollutants beneath the top wall of the separation compartment. This layer floats on the underlying water in the separation compartment.

During the discharge phase, the layer of pollutants collected beneath the top wall of the separation compartment is dispelled from the separation compartment through a riser outlet by introducing water as a displacing liquid into the separation compartment beneath the layer of pollutants.

As actually used, the skimmer apparatus by means of which the method is implemented operates automatically, the intake and discharge phases being initiated and terminated under control based on sensing the interfaces between the pollutant and water layers in the separation compartment and the riser outlet. According to WO01/12905 A1, the sensing is carried out using ultrasonic sensors, but other types of sensors may also be used.

In order that the collection may take place efficiently, the control of the intake and discharge phases must be controlled in a reliable manner and include a possibility to simple adaptation to the conditions existing in each case, such as the amount of heavier particles which are carried by the skimmed surface layer into the collection vessel and settle therein, the composition and viscosity of the pollutants, etc. The pollutants often comprise a mixture of solid and liquid pollutants and may partially have a density higher than that of the water in the skimmed surface layer and partially have a lower density than the water.

Using conventional sensors it is difficult to control the intake and discharge phases reliably in a satisfactory manner. Ultrasonic sensors, for example, may operate in an excellent manner if they are properly set for the layers on which the sound is to be reflected or which the sound is to penetrate, but if the density or sonic transmission properties of the layer should change, the setting of the sensor has to be changed. If particles enter the region of the sensors, the function is affected in an unpredictable manner.

Other sensors which may be contemplated for the detection of the interfaces or density differences between the layer of pollutants and the water carrying the layer suffer for diverse problems which make it difficult to have a satisfactory control of the intake and the discharge in all operating situations.

A further problem is caused by the fact that the skimmed surface layer often contains material that has a higher density than the water of the surface layer but is nevertheless entrained by the surface layer and carried into the collection vessel. In the collection vessel, however, this material may settle because of the low flow velocities which exist, especially in the separation compartment. The settled material may collect on the bottom wall of the separation compartment and gradually load the collection vessel heavily enough to jeopardize the function of the skimmer apparatus.

OBJECT AND SUMMARY OF THE INVENTION

The problem to be solved by the invention is to provide a method of the kind indicated in which the initiation and termination of the intake and discharge phases can be controlled reliably in a satisfactory manner.

In accordance with the invention, the solution to this problem is based on monitoring the changes of the weight of the collection vessel in the body of water during the operating cycle and initiating the intake and discharge phases in response to the said weight reaching predetermined values. These changes can be monitored in different ways.

One way is to measure the distance between the surface of the body of water and reference point which is fixed relative to the collection vessel and situated above the surface of the body of water. The changes manifest themselves by changes in the depth of immersion of the collection vessel. The distance measurement can be carried out using an echo sounder, for example.

Another way is to directly measure the weight of the collection vessel in the body of water using a load cell.

The invention also relates to apparatus for the implementation of the method according to the invention and to a software product which is especially for use in carrying out the method according to the invention using a computer and auxiliary means coacting with it. Use of this software product may take place exclusively locally in the collection apparatus using a computer installed therein or via a communication link using a server which is geographically separated from the collection apparatus, such as a server which can be accessed via the Internet.

The invention will be described in greater detail with reference to the accompanying diagrammatic drawings.

DETAILED DESCRIPTION OF THE PREFERRED EMBODIMENT(S) OF THE INVENTION

Figure 1:
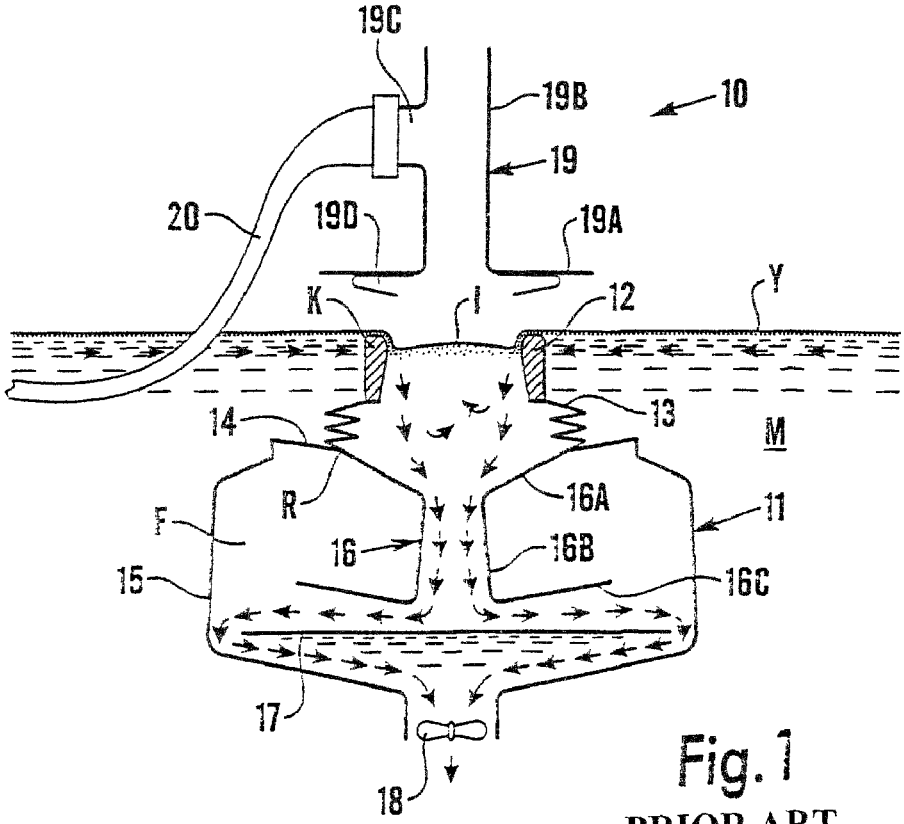
Fig. 1 PRIOR ART
FIGS. 1 to 3 are vertical sectional views illustrating different phases of a cycle of operation of a known skimmer apparatus of the kind with which the invention is concerned, FIG. 1 showing an initial part of an intake phase, FIG. 2 showing a final part of the intake phase and FIG. 3 showing a part of a discharge phase.
Figure 2:
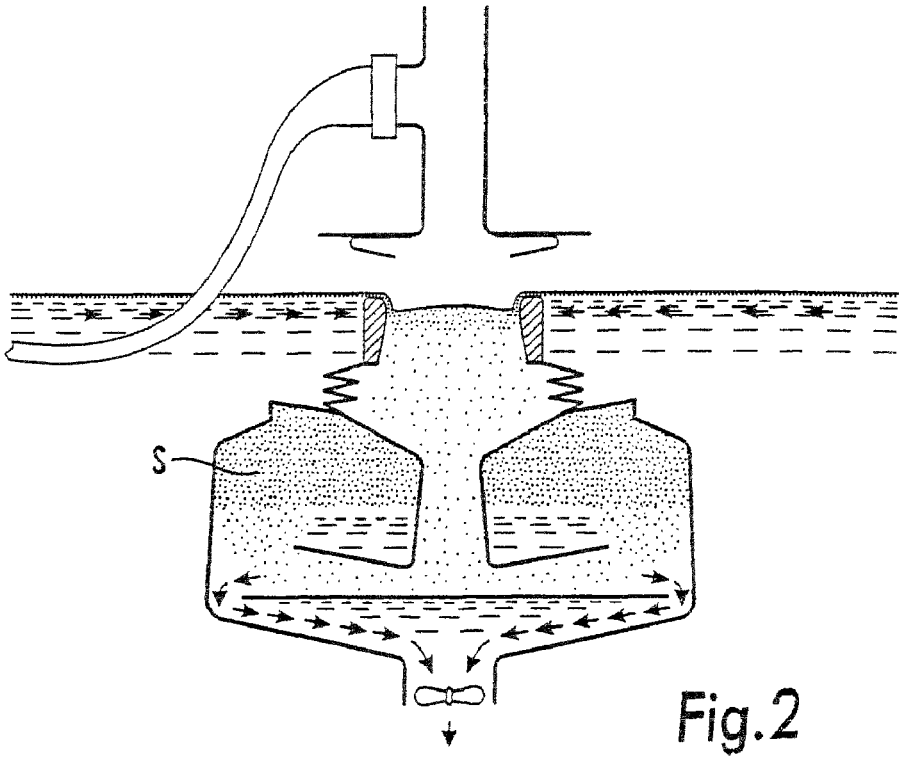
Fig. 2 PRIOR ART
Figure 3:
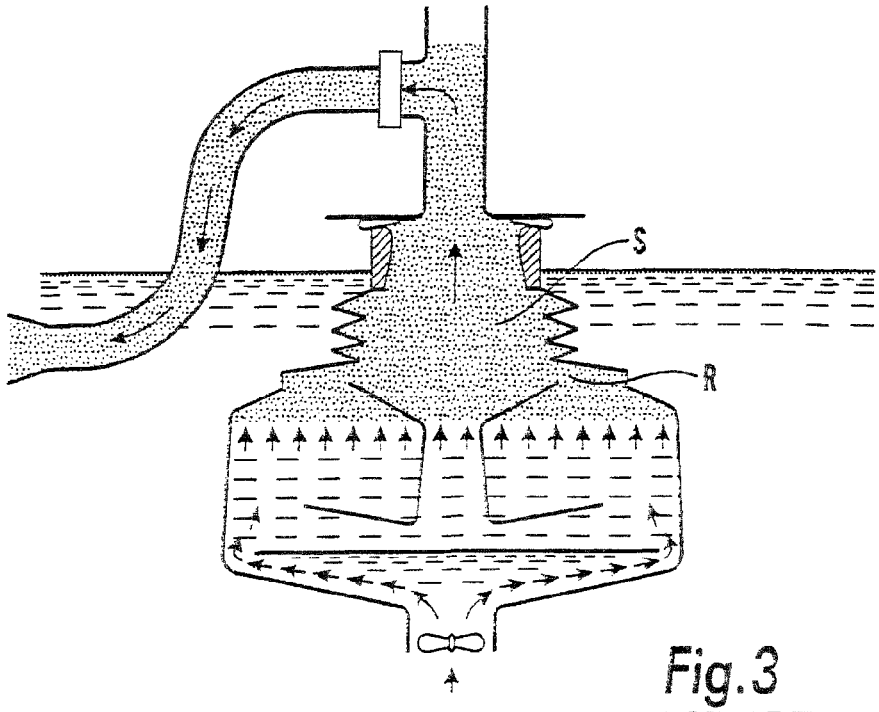
Fig.3 PRIOR ART

The skimmer apparatus 10 diagrammatically shown in FIGS. 1 to 3 is constructed substantially in accordance with WO01/12095 A1 and will be described only to the extent necessary for the understanding of the present invention.

The skimmer apparatus 10 comprises a collection vessel 11, which is designed in operation to be immersed in the body of water M the surface layer Y of which carries the pollutants to be collected and disposed of with the aid of the skimmer apparatus.

An annular intake member 12 in the collection vessel 11 is formed by a buoyant ring the crest K of which defines an overflow inlet I and the lover side of which merges with or is attached to the upper end of an upstanding annular accordion-type bellows 13. At its lower end, this bellows is attached to the inner edge of an annular diaphragm disk 14, an outer edge of which is attached to the upper edge of a bowl-shaped, rigid container section 15.

An upstanding conduit element 16 is centrally located in the container section 15 and stationary with respect to the latter. A funnel-shaped upper part 16A of the conduit element 16 is connected with a tubular lower part 16B, the lower end of which merges with an obliquely upwardly and outwardly directed annular flange 16C. Slightly spaced downwardly from the conduit element 16 a stationary horizontal plate 17 is mounted in the container section 15. The peripheral edge of the plate and the wall of the container section 15 define an annular gap.

In the bottom wall of the container section 15 a central opening is provided in which a reversible pump 18 (symbolically illustrated as a propeller) driven by an electric motor is mounted to pump water in both directions between the interior of the collection vessel 11 and the surrounding body M of water. The speed of the pump, that is, the rotational speed of its motor, is variable.

The annular diaphragm disk 14 forms a valve member which co-acts with the upper edge of the funnel-shaped upper part 16A of the conduit element 16 so as in a closed position, shown in FIGS. 1 and 2, to block a through-flow passage R between the interior of the bellows 13 and the space, hereinafter designated as the separation compartment F, in the container section which surrounds the conduit element 16 and in an open position, shown in FIG. 3, to allow flow through that passage R from the separation compartment F to the interior of the bellows 13.

Above the intake member 12, an outlet member 19 is provided which is mounted in a manner not shown in FIG. 3 to be stationary with respect to the container section 15. The outlet member 19 comprises a horizontal annular plate 19A with a central opening and a vertical riser outlet tube 19B connected to the opening. At its upper end the riser outlet tube is open to the ambient atmosphere. Slightly below this end the riser outlet tube 19B has a side outlet 19B to which a recipient bag 20 is connected. On its underside, the annular plate 19A has an annular seal 19D which extends about the central opening in the annular plate and coacts with the crest K of the intake member.

When immersed in the body M of water, the collection vessel 11 is supported by a number of buoyant bodies 21 (not shown in FIGS. 1 to 3, one such buoyant body is shown in FIGS. 4 to 8). These buoyant bodies are secured to the container section 15 of the collection vessel 15 and are also joined with the outlet member 19 to keep it in position.

When the skimmer apparatus 10 is to be put into operation to separate from the body of water pollutants of lower density than the water, it is put down into the body of water. The collection vessel 11 is immediately filled with water through the bottom opening (pump 18 is inoperative).

An intake phase of the operating cycle of the skimmer apparatus is initiated by starting the pump 18 to pump water out of the collection vessel 11. This pumping is indicated by arrows in FIG. 1. A water sink is formed in the inlet I within the intake member 12 which as a result takes an underwater position so that the surface layer Y of the body of water flows across the crest K of the intake member 12 into the collection vessel 11.

The flow of surface layer water and pollutants entrained thereby continues downwardly through the conduit element 16 and is deflected outwardly at the lower end of the conduit element. As a result of the drastic reduction of the velocity of the deflected flow, pollutants having a density lower than that of the water is allowed to turn upwardly into the separation compartment F and collect therein to form a layer S beneath the top wall formed by the upper part 16A of the conduit element 16 and an inwardly turned upper part of the wall of the container section 15 (FIG. 2). The water freed of the pollutants passes through the annular gap around the plate 17 and enters the body M of water.

When the build-up of the layer S of pollutants has been going on for some time, the intake phase is terminated and a discharge phase is initiated by reversing the pump 18 to pump water from the body M of water into the collection vessel 11. The intake member 12 will then immediately be raised and engaged with the annular seal 19D. The diaphragm disc 14 will be loaded from below and forced upwardly to open the passage R. Upon continued pumping of water into the collection vessel, the pollutants in the layer S will be forced upwardly into the riser outlet tube 19B unto it flows through the lateral outlet 19C into the recipient bag 20 which lies on or in the water. This is shown in FIG. 3.

When the pollutants have been completely expelled from the collection vessel 11 in this manner, the pump 18 is again reversed so that the discharge phase is terminated and a new intake phase is initiated.

Figure 4:
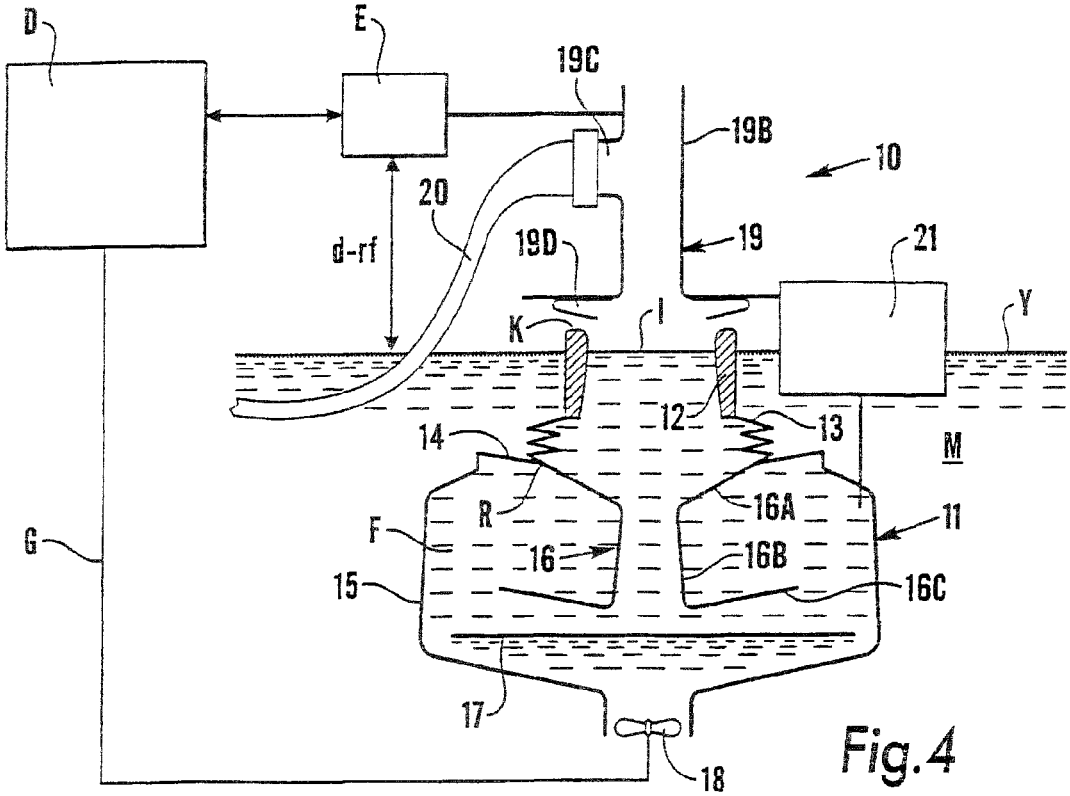
FIG. 4 illustrates the skimmer apparatus of FIG. 1 provided with means for implementing the method according to the invention, namely in a situation when the apparatus has been deployed in a body of water but is not yet in operation.
Figure 5:
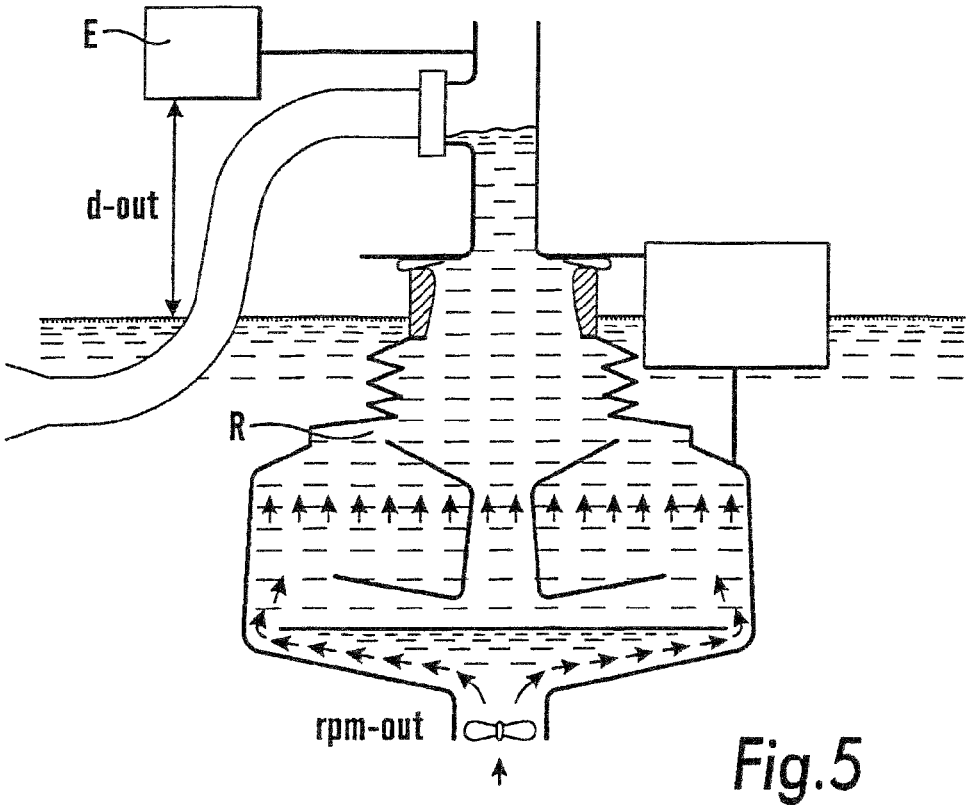
FIGS. 5 to 8 show different sequential steps in the preparation of the apparatus for operation in a body of water from which pollutant material is to be collected.
Figure 6:
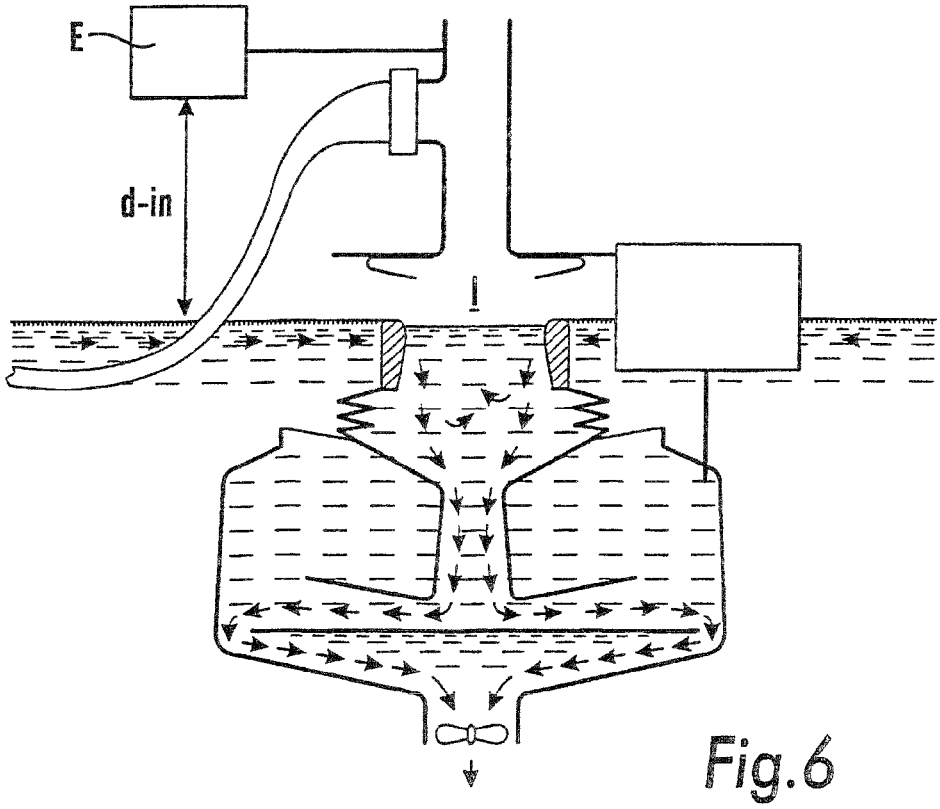

As shown in FIG. 4, the skimmer apparatus is provided with an echo sounder E by which the distance d between the water surface (surface layer Y) and a reference point which is fixed with respect to the collection vessel 11 can be continuously determined. Over a line G, a signal representative of the distance d is fed G as input data into a computer unit D which controls and monitors the pump 18 of the skimmer apparatus.

Before the skimmer apparatus 10 is made ready for operation in a body M of water, it has to be prepared to operate in accordance with the method according to the invention. It is here presumed to be clean exteriorly and interiorly, that is, free from foreign matter when it is placed in the body of water.

When the skimmer apparatus has come to rest in the state shown in FIG. 4, the distance d is determined and stored in the computer unit D as a reference value, here designated as d-rf. Then a "mock" discharge phase is initiated through an instruction from the computer unit to the pump 18 to start pumping water into the collection vessel 11, so that the intake member 12 seals against the outlet member 19 and substantially pure water is forced upwardly into the riser tube 19B. Just at the moment water starts flowing from the lateral outlet 19C on the riser tube 19B (see FIG. 5), the computer unit D registers the pump motor speed, here designated as rpm-out, and the distance, d-out, to the surface layer Y. The values thus registered are representative of the density of the water and the level of the lateral outlet 19C. The pump motor speed varies as a function of the hydrostatic or head pressure the pump operates against. That pressure is proportional to the density of the liquid and the height of the liquid column in the riser outlet tube 19B.

The intake phase is initiated by reversing the pump 18 to cause it to pump water out of the collection vessel 11. When the inflow of the surface layer Y of the body of water commences, that is, before any appreciable amount of pollutants has been collected in the collection vessel 11, the value of the distance d at that time is registered, see FIG. 6. This value, which is here designated as d-in and is smaller than d-rf, is greater than d-out, because a water sink—a water level lower than the level of the surrounding body of water—has been formed in the inlet I inside the intake member 12. The weight of the collection vessel 11, including its contents of liquid, in the body M of water has therefore been reduced and, as a consequence, the container section 15 of the collection vessel has taken a somewhat higher position in the body of water than in FIG. 5.

Figure 7:
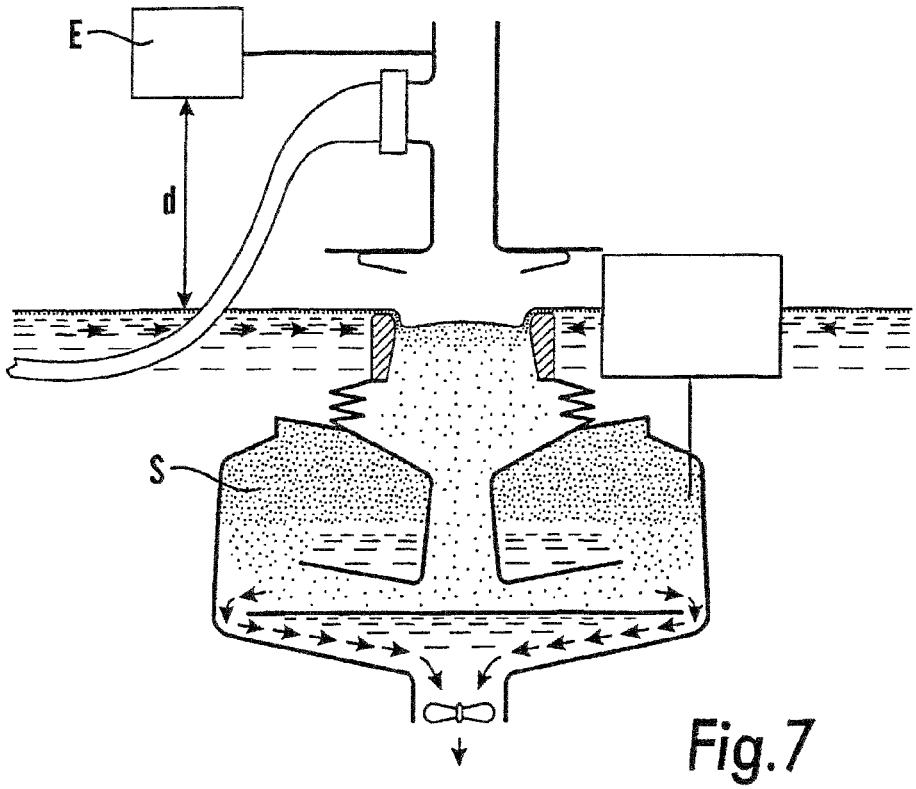
Figure 8:
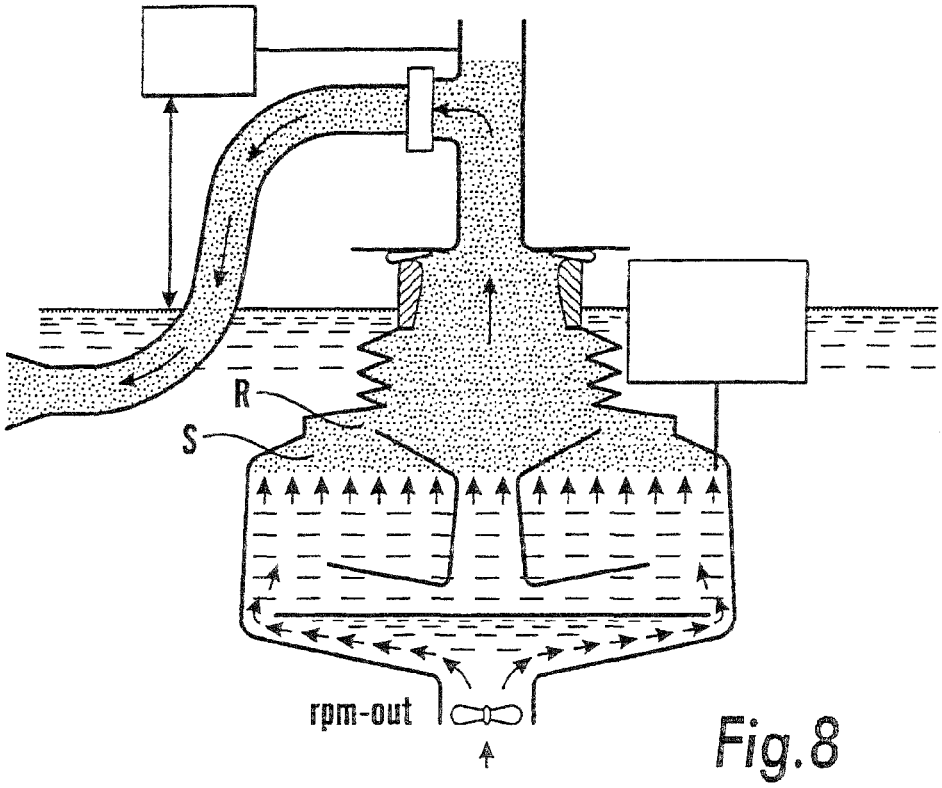

During the continued intake phase, a layer S of pollutants is gradually built up until it has reached a given appropriate height or volume in the separation compartment F, see FIG. 7. As the layer S grows, the container section 15 rises further in the body of water (the layer replaces a corresponding volume of the heavier water), so that the weight of the collection vessel decreases and the distance d thus increases. The increase of the distance d is dependent not only on the growth of the layer but also on the density of the layer.

The layer S may not be allowed to grow in the separation compartment beyond a given height or volume. The limit value of the height or the volume, here designated as V-max, depends on the density of the layer S and may therefore be different for different pollutants.

For a determination of V-max in a certain case, a discharge phase is effected (FIG. 8) when a layer S of a certain unknown height or volume has been formed in the separation compartment F. The value of the distance d at the time the discharge phase is terminated is registered; this value is here designated as d-cal. Then the pump 18 is reversed and controlled to operate at the speed of rpm-out. Because the density of the layer S is lower than that of the water, this speed is sufficient to expel all of the pollutants through the outlet member 19.

When substantially pure water reaches the lateral outlet 19C, the feeding of water into the collection vessel 11 is terminated. The volume of pollutants expelled when the pure water just about reaches the lateral outlet 19C is determined. From the value of the volume and the difference between d-cal and d-out it is possible to derive a measure of the change of distance d per unit volume of pollutants in the collection vessel. Then the computer unit can be supplied with instructions about the value of the distance d for which the intake phase is to be terminated. Suitably, this value is selected such that a margin of safety remains until the separation of pollutants from the water is endangered by pollutants being entrained with the water from the collection vessel.

Instead of controlling the expulsion of the pollutants on the basis of rpm-out it is possible to terminate the discharge phase when the value of the distance d approaches d-out. When the discharge phase is initiated the distance d is greater than the distance d-out, but it approaches d-out in proportion to the replacement of the heavier water with the layer S of pollutants. It is appropriate to cause the computer unit to initiate the termination of the discharge phase slightly before the distance d becomes equal to d-out so that a safety margin remains against the discharge phase not being terminated in time, before water is driven out into the recipient bag 20.

Heavier particles, such as grains of gravel and sand, entrained by the inflowing surface layer Y ha a tendency to settle in the collection vessel and remain there. Over an extended period of operation they may gradually increase the weight of the collection vessel to a substantial extent. As a consequence, the previously made determinations of d-rf and d-out may become invalid.

Unless compensation is made for such an increase of the weight, V-max may be exceeded during the intake phase so that water may be expelled into the recipient bag during the discharge phase. It may be appropriate, therefore, at suitable intervals to cause the computer unit D to carry out an automatic calibration similar to that described above.

To that end the computer unit D will allow a discharge phase to proceed until the distance d has exceeded d-out and no longer changes. The value the distance d has when in no longer decreases during the extended discharge phase is registered. The computer unit subtracts the absolute value of the difference between d-out and the just-mentioned value of the distance from d-rf, which thus assumes a new value. If the sum of the changes of d-rf after one or more such automatic calibrations exceeds a given figure, the computer signals a requirement for a cleaning. The computer unit may then also start a sprinkler system incorporated in the skimmer apparatus 10 to flush away the collected heavier pollutants.

As described above, the control of the intake and discharge phases is based on determinations of the distance between the surface layer Y of the body M of water and a reference point which is fixed relative to the skimmer apparatus in the vertical direction and situated above the surface layer.

This distance is a function of the weight that the skimmer apparatus 10 with the collection vessel 11 and its contents of liquid and any solid particles has in the body of water in which the skimmer apparatus is operating.

Figure 9:
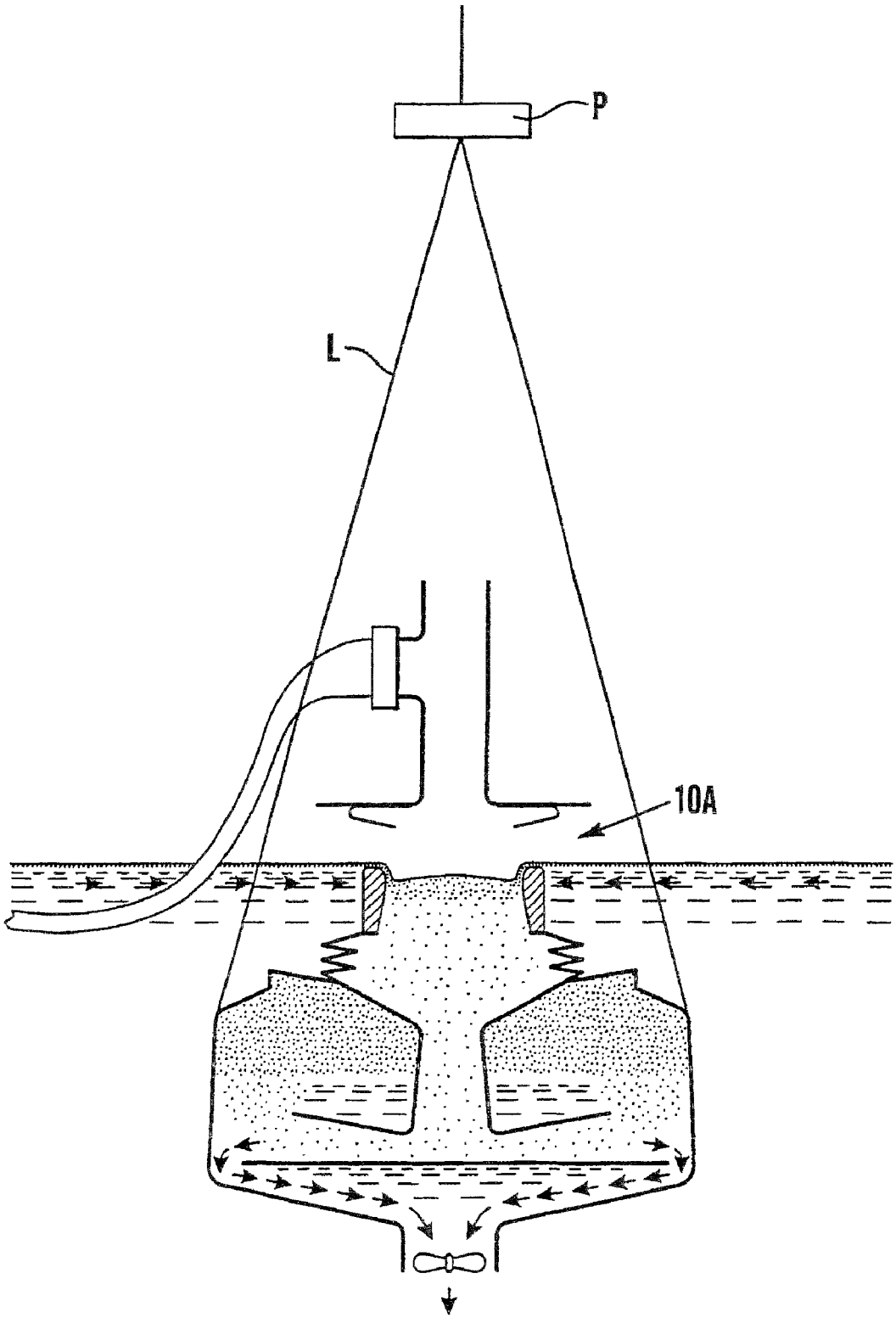
FIGS. 9 and 10 show two modified forms of the skimmer apparatus of FIG. 4
Figure 10:
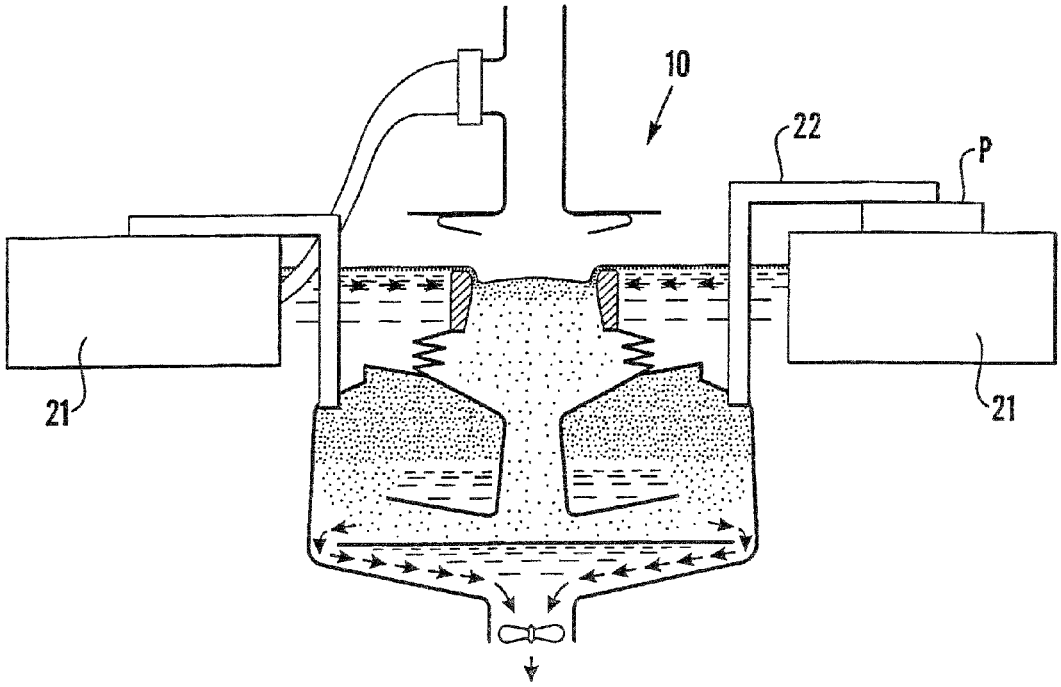

Accordingly, the control may also be based on a direct measurement of that weight using one or more load cells or other suitable weighing means. FIGS. 9 and 10 illustrate two embodiments of the skimmer apparatus in which the weight is measured by means of one or more load cells.

In the embodiment shown in FIG. 9 the skimmer apparatus 10A has no buoyant bodies corresponding to the buoyant bodies 21 in FIGS. 4 to 8. Instead, it is kept suspended in position in the body M of water by a line or some other suspension mount L. A load cell P, which is inserted in the suspension mount L to continuously sense the weight of the skimmer apparatus 10A in the body of water and produce an output signal representative of the weight, is connected to the computer unit D which operates to carry out data processing, calibration and control of the functions of the skimmer apparatus in the same manner as in the skimmer apparatus 10 in FIGS. 4 to 8.

The skimmer apparatus 10A may also be stationary, e.g. mounted on a stand in a basin, with one or more load cells positioned between the skimmer apparatus and the stand to sense the weight of the skimmer apparatus in the body of water held in the basin.

The skimmer apparatus 10 shown in FIG. 10 corresponds to that shown in FIGS. 4 to 8, the only substantial difference being that a load cell P similar to the load cell P in FIG. 9 is placed between at least one of the buoyant bodies 21 and a mount 22 by which the buoyant bodies support the collection vessel 11.

The applicability of the invention is not restricted to cyclical collection of pollutants from a body of water. In an embodiment which is generalised over the described embodiments the invention may also be applied to continuous collection for monitoring the status of the collection apparatus. For example, it is possible in a collection system in which the water from which pollutants are to be separated is continuously flowing through the collection vessel. At any given point in time, the amount of pollutants that is in the collection vessel corresponds to the weight that the collection vessel, including its contents of water and pollutants, has in the body of water. In the manner described above, this weight can be continuously determined by determining the level of the collection vessel in the body of water or by direct weighing, such as by means of a load cell.

A conceivable application of that nature may be for monitoring a water surface for the presence of pollutants, such as oil spill. As long as the surface or surface layer of the body of water is free from gravimetrically separable material, the water passes through the collection vessel without change of the weight of the collection vessel in the body of water. If an oil spill or other pollution of the water occurs, the collection apparatus will separate the pollutants from the water in the collection vessel, and the resulting change of the collection vessel in the water can be detected and signalled. Thus, the collection device can immediately separate the pollutants and in addition signal the change of status that it has undergone.

The invention claimed is:

1. A cyclical method for collecting pollutants having a density lower than that of water and carried by a surface layer of a body of water, in which:

in an intake phase of a cycle of operation, water of the surface layer is caused to flow into and through a collection vessel having a separation compartment with a top wall, pollutants entrained by the inflowing surface layer water are allowed to collect gravimetrically as a supernatant layer carried beneath the top wall of the separation compartment on water in the separation compartment, during a discharge phase of the cycle of operation, the layer of pollutants collected beneath the top wall of the separation compartment is dispelled from the separation compartment through a riser outlet communicating with the separation compartment by means of displacing water introduced into the separation compartment beneath the supernatant layer, wherein the changes of the weight of the collection vessel in the body of water are monitored during the cycle of operation by directly weighing the collection vessel in the body of water in which the weighing of the collection vessel is made by one or more load cells, and the intake and discharge phases are initiated and terminated in response to the said weight reaching predetermined values.

2. The method according to claim 1, wherein the changes are continuously monitored by weighing the collection vessel in the water.

3. A cyclically operating apparatus for collecting pollutants having a density lower than that of water and carried by a surface layer of a body of water, said apparatus comprising a collection vessel which is immersible in the body of water and includes:

a separation compartment having a top wall and adapted, during an intake phase of an operating cycle, to receive surface layer water coming from the body of water and to separate pollutants out of the water to a layer of pollutants situated directly beneath the top wall and carried by underlying water, an inlet for the intake of the surface layer water from the body of water during the intake phase, the inlet communicating with the separation compartment, an outlet device adapted, during a discharge phase of the operating cycle, to discharge the layer of pollutants under the action of displacing water fed into the separation compartment, a pump for transporting water between the surrounding body of water and the collection vessel, and a control device for controlling the pump in operating cycles, each operating cycle comprising an intake phase and a discharge phase, wherein the control device comprises load cell means for monitoring changes of the weight of the collection vessel in the body of water during the operating cycle by directly weighing the collection vessel in the body of water and for initiating and terminating the intake and discharge phases in response to the said weight reaching predetermined values.

4. The cyclically operating apparatus according to claim 3, further comprising one or more load cells for directly weighing the collection in the body of water.

* * * * *